US005540612A

United States Patent [19]

Mendez

[11] Patent Number: 5,540,612

[45] Date of Patent: Jul. 30, 1996

[54] SIMULATED EYES FOR TOYS HAVING CONVEX LENS BODY

[75] Inventor: Susan K. Mendez, Hermosa Beach, Calif.

[73] Assignee: Mattel, Inc., El Segundo, Calif.

[21] Appl. No.: 385,028

[22] Filed: Feb. 7, 1995

[51] Int. Cl.[6] ..... A63H 3/38

[52] U.S. Cl. ..... 446/392; 623/4

[58] Field of Search ..... 446/392, 389, 446/372; 623/4, 5; 434/296, 295

[56] References Cited

U.S. PATENT DOCUMENTS

| | | | |
|---|---|---|---|
| 946,013 | 1/1910 | Clarke | 446/372 |
| 1,268,885 | 6/1918 | Sampson | 623/4 |
| 1,289,643 | 12/1918 | Burlich | 446/392 |
| 1,337,354 | 4/1920 | Garrigue | 446/389 X |
| 1,740,675 | 12/1929 | Wilhelm | 446/392 |
| 1,763,312 | 6/1930 | Marcus | 446/389 |
| 1,832,743 | 11/1931 | Shuldiner | 446/392 |
| 1,979,321 | 11/1934 | Dunner | 446/219 |
| 2,051,876 | 8/1936 | Marcus | 446/389 |
| 2,394,400 | 2/1946 | Noles | 264/132 |
| 2,497,872 | 2/1950 | Erpf et al. | 623/4 |
| 2,571,721 | 10/1951 | Jardon | 623/4 |
| 2,580,583 | 1/1952 | Noelle | 623/4 |
| 2,589,462 | 3/1952 | Wagner | 446/392 |
| 2,634,423 | 4/1953 | Clarke | 623/4 |
| 2,791,869 | 5/1957 | Wagner | 446/392 |
| 3,092,931 | 6/1963 | Samo | 446/389 |
| 3,846,199 | 11/1974 | Cappelli | 623/4 X |
| 3,871,128 | 3/1975 | Grooms | 446/372 |
| 3,952,445 | 4/1976 | Liebert | 446/389 X |
| 4,601,673 | 7/1986 | Nasca | 446/389 |
| 4,629,442 | 12/1986 | Samo | 446/389 |
| 4,637,159 | 1/1987 | Kulis | 446/392 X |
| 4,828,531 | 5/1989 | Kuhn | 446/392 |
| 4,875,888 | 10/1989 | Harvey | 446/392 |
| 5,026,392 | 6/1991 | Gordon | 623/4 |
| 5,037,344 | 8/1991 | Secrist | 446/392 |
| 5,108,427 | 4/1992 | Majercik et al. | 446/392 X |

*Primary Examiner*—Mickey Yu
*Attorney, Agent, or Firm*—Roy A. Ekstrand

[57] ABSTRACT

A simulated eye for toys includes a convex generally teardrop shaped lens formed of a clear material such as plastic and having a planar rear surface. A color layer having a plurality of color areas is formed upon the rear surface of the lens. An attachment post extends from the rear surface to provide for attachment of the simulated eye to a host toy figure. The convex lens cooperates with the color layer to provide a novel appearance in which the convex lens appears to be filled with the colors of the color area when the simulated eye is viewed.

5 Claims, 1 Drawing Sheet

SIMULATED EYES FOR TOYS HAVING CONVEX LENS BODY

FIELD OF THE INVENTION

This invention relates generally to simulated eyes and particularly to simulated eyes used in dolls and toys.

BACKGROUND OF THE INVENTION

Dolls and plush toys have for many years been a popular toy category which manufacturers of toy products have pursued with wide ranging effort. As a result, a virtually endless variety of dolls and plush toys have been produced assuming human and animal forms as well as fantasy characters. The fabrication of such dolls and plush toys has also enjoyed substantial development and, as a result, constructions using molded figures as well as fabric covered figures and plush material figures have been provided. Perhaps one of most difficult features of such dolls and plush toys to successfully fabricate is found in the eyes of the figure. Because eyes often dominate the "look" or character and impact of dolls and toy figures, great effort is expended to provide the desired appearance. In many dolls replicating human infants or human children for example, the objective is maximum realism to produce an eye which closely resembles the human eye. In other figures such as fanciful plush replicating fanciful creatures, animals or persons, the emotional appeal or character of the eye often dominates and supersedes realism.

Because the eye construction represents an important factor in the success of dolls and plush figures, practitioners in the art have endeavored to provide a variety of simulated eyes having different appearances. In addition, related technology and effort has been expended in the more serious sciences dedicated to producing realistic artificial eyes for human eye replacement. As a result, a variety of wide ranging efforts have been directed toward fabrication of different simulated eyes throughout several industries.

For example, U.S. Pat. No. 1,268,885 issued to Sampson sets forth an ARTIFICIAL EYE AND METHOD OF FITTING THE SAME having a thin convex artificial member supporting a simulated pupil near the center thereof.

U.S. Pat. No. 1,289,643 issued to Burlich sets forth an SIMULATED EYE having a generally spherical eye body coupled to a support post and having a simulated iris and pupil formed therein.

U.S. Pat. No. 1,337,354 issued to Garrigue sets forth a TOY having simulated eyes formed by hemispherical bodies supported upon a generally planar circular disk and support post for attachment.

U.S. Pat. No. 1,740,675 issued to Wilhelm sets forth ARTIFICIAL EYES having a hollow generally spherical shell defining a center aperture within which a simulated pupil and iris are supported. A clear lens is secured to the shell and fitted within the aperture to simulate a cornea.

U.S. Pat. No. 1,763,312 issued to Marcus sets forth an ARTIFICIAL EYE having a spherical hollow shell defining a circular recess near the center portion thereof. A plurality of planar and annular disks are received within the recess and support a simulated pupil and iris. A clear simulated cornea overlies the simulated iris.

U.S. Pat. No. 1,832,743 issued to Shuldiner sets forth an ARTIFICIAL ANIMAL EYE having an elongated somewhat elliptical support shell within which a simulated cornea and pupil are secured. A center post is secured to the underside of the shell at its approximate center for attachment of the eye.

U.S. Pat. No. 2,051,876 issued to Marcus sets forth a DOLL EYE AND METHOD OF MAKING SAME having a spherical hollow body supporting a simulated cornea and iris and pupil and having a planar attachment plate secured to the rear portion thereof which receives a transversely extending attachment post.

U.S. Pat. No. 2,394,400 issued to Noles sets forth a METHOD 0F MAKING ARTIFICIAL EYES having a convex body defining a center recess within which a simulated pupil and iris are received and having a simulated cornea extending thereacross.

U.S. Pat. No. 2,497,872 issued to Erph, et al. sets forth an ARTIFICIAL EYE having a simulated iris and pupil formed by a plurality of disk members secured in a stacked array.

U.S. Pat. No. 2,634,423 issued to Clarke sets forth an ARTIFICIAL EYE AND METHOD OF ATTACHING SAME having an eye body secured at the center point thereof by a plurality of flexible fibers or cords encircling a transversely extending post.

U.S. Pat. No. 2,580,583 issued to Noelle sets forth an ARTIFICIAL EYE having a convex simulated eye body having a plurality of planar disks some defining apertures therethrough configured to simulate an iris and pupil.

U.S. Pat. No. 2,571,721 issued to Jardon sets forth an ARTIFICIAL EYE having a hemispherical body which receives and supports a tapered convex simulated eye facing. Means are provided for securing the hemispherical body during attachment.

U.S. Pat. No. 2,589,462 issued Wagner sets forth a DOLL'S EYE having a hemispherical eye body including a rearwardly extending attachment post and a facet formed on the center front surface thereof. A simulated iris and pupil as well as simulated highlight element are painted upon the front surface.

U.S. Pat. No. 2,791,869 issued to Wagner sets forth DOLL'S EYES having a generally hemispherical eye body formed of a transparent material and supporting a rearwardly extending attachment post.

U.S. Pat. No. 3,092,931 issued to Samo sets forth a DOLL EYE having a generally spherical body supporting a transversely extending support post and having a simulated iris and pupil formed therein.

U.S. Pat. No. 3,846,199 issued to Cappelli sets forth an ARTIFICIAL EYE AND METHOD OF CONSTRUCTION having a convexly curved body defining a center recess within which a plurality of disk-shaped elements having apertures formed therein are received. A simulated cornea is further received within the recess and secures the disks in position.

U.S. Pat. No. 3,952,445 issued to Liebert sets forth a SIMULATED EYE CONSTRUCTION having a cup-shaped transparent body supporting an embedded flat wafer near the apex of the transparent body.

U.S. Pat. No. 4,601,673 issued to Nasca sets forth an ARTIFICIAL EYE including a sclera for insertion into an eye socket. The sclera defines a cavity therein for forming the pupil of the eye and is made of a soft elastic material having a transparent cornea.

U.S. Pat. No. 4,629,442 issued to Samo sets forth an ARTIFICIAL EYE FOR DOLL having two generally spherical halves secured together by solvent or adhesive formed of clear glass or plastic in which the front half supports an internal surface supporting eye components.

U.S. Pat. No. 4,637,159 issued to Kulis sets forth an ARTIFICIAL EYE having a generally cup-shaped member including a protruding transparent first lens portion having a convex outer face and a concave inner face. A transparent second lens member is positioned in the cup-shaped member behind the first lens portion together with a reflective structure.

U.S. Pat. No. 4,828,531 issued to Kuhn sets forth SYNTHETIC EYE SIMULATING EYEBALL MOVEMENT within a toy figure which create an optical illusion giving the appearance of eyeball movement as the observer changes position with respect to the figure.

U.S. Pat. No. 4,875,888 issued to Harvey sets forth an EYE CONSTRUCTION FOR TOY DOLL having a substantially circular concentric pupil and iris portion together with a white portion encircling the iris and a transparent cover overlying the white portion.

U.S. Pat. No. 5,026,392 issued to Gordon sets forth a PROSTHETIC EYE having a spherical body shaped to replicate a natural eye which is provided with receiving regions extending radially from the eye and tabs for attachment to the eye muscles.

U.S. Pat. No. 5,037,344 issued to Secrist sets forth a REALISTIC UNIVERSAL FITTING PLASTIC DOLL EYE having a cup-shaped outer body supporting a similarly cup-shaped interior body. The outer body defines a convex simulated cornea while the inner body supports a simulated iris formed on an annular disk. The inner body is fitted within the outer body to captivate the simulated iris beneath the cornea portion of the outer body.

While the foregoing described prior art devices have provided a great variety of simulated eye structures, there remains nonetheless a continuing need in the art for evermore interesting and improved simulated eyes for use in dolls and plush toy figures.

SUMMARY OF THE INVENTION

Accordingly, it is a general object of the present invention to provide an improved simulated eye for doll or plush toy figure. It is a more particular object of the present invention to provide an improved simulated eye for doll or plush toy figure having an unusual and striking appearance which is easy to manufacture and low in material cost.

In accordance with the present invention, there is provided a simulated eye for use in combination with a toy which comprises: a convex lens having a lens body defining a convexly curved front surface and a generally planar rear surface and an outer edge; means for attaching the convex lens to a toy extending from the rear surface; and a color layer having a plurality of differently colored color areas formed upon the rear surface, the convex lens and the color areas cooperating to cause the color areas to appear to fill the lens body when the simulated eye is viewed from a frontal position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
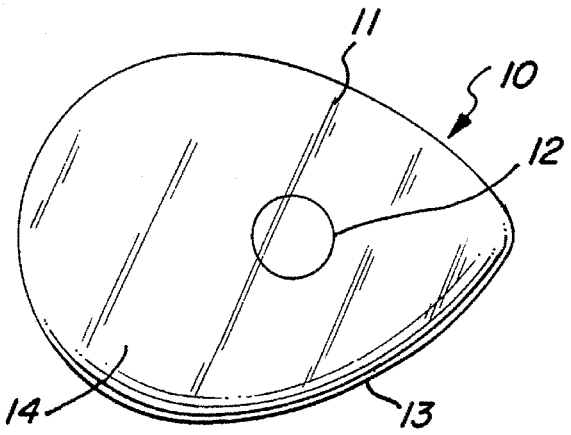
FIG. 1 sets forth a front view of the lens portion of the present invention simulated eye.

FIG. 1 sets forth a front view of an eye body constructed in accordance with the present invention and generally referenced by numeral 10. Eye body 10 is preferably formed of a transparent material such as clear plastic or the like. It will be apparent to those skilled in the art, however, that if preferred, eye body 10 may be formed of a tinted transparent material such as tinted plastic or the like. In either event, eye body 10 defines a general tear-drop outer edge 13 and forms a convex lens portion 11 supporting an attachment post 12 in the manner better seen in FIG. 2. Convex lens 11 defines a convex front surface 14. As is better seen in FIG. 2, eye body 10 further defines a generally planar rear surface 15 to which attachment post 12 is secured. It will be apparent to those skilled in the art that the general tear-drop shape of eye body 10 may be utilized in a variety of dolls and toy figures and may be oriented with respect to such figures in a variety of angular positions. It will be equally apparent to those skilled in the art that the present invention is not limited to the tear-drop shape of eye body 10 but may be fabricated using other shapes such as elliptical or round or the like. The important aspect of eye body 10 with respect to the present invention is the provision of a convex lens 11 which provides the dramatic effect described below in greater detail.

Figure 2:
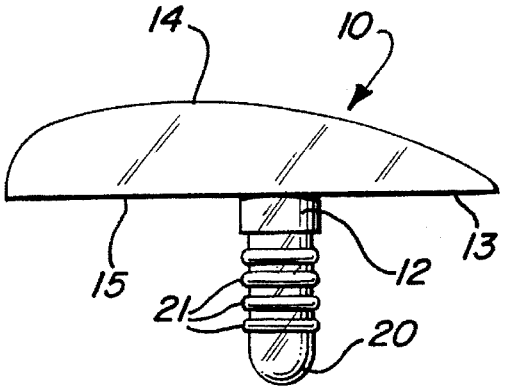
FIG. 2 sets forth a side view of the lens portion of the present invention simulated eye.

FIG. 2 sets forth a side view of eye body 10 having convex lens 11 secured to an attachment post 12. Lens 11 defines an outer edge 13 and a convex front surface 14. Eye body 10 further forms a generally planar rear surface 15 from which attachment post 12 extends. Attachment post 12 is generally cylindrical in shape and defines a plurality of angular ribs 21 and dome-shaped end 20.

While it may in some instances be desirable to fabricate attachment post 12 separate from convex lens 11 and secure attachment post 12 to rear surface 15 using conventional attachment techniques such as adhesive bonding or the like, in its preferred form eye body 10 including lens 11 and attachment post 12 is formed of a single integral molded plastic member.

Figure 3:
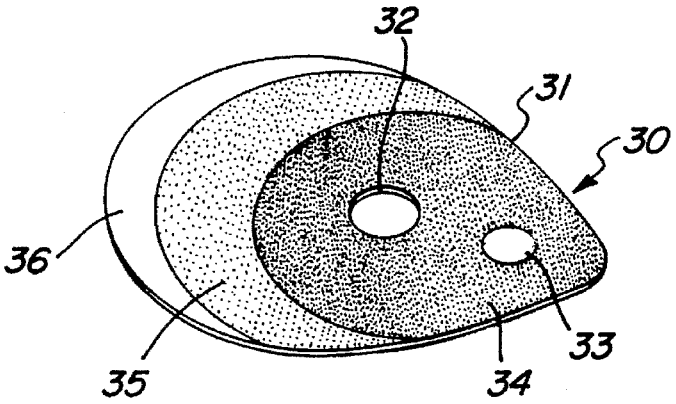
FIG. 3 sets forth a perspective view of the rear surface multicolored layer of the present invention simulated eye.
Figure 4:
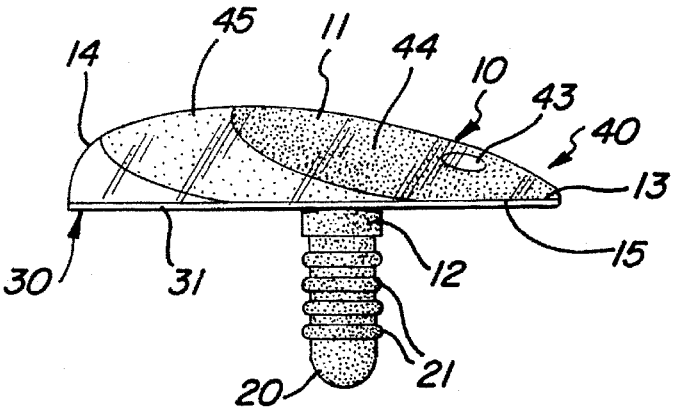
FIG. 4 sets forth a side view of the present invention simulated eye completely assembled.

FIG. 3 sets forth a perspective view of a multicolored color layer generally referenced by numeral 30 for use in combination with eye body 10 to form the present invention simulated eye shown in FIG. 4. It should be noted that color layer 30 in its preferred form is fabricated by applying colored material to rear surface 15 of eye body 10 to provide the present invention simulated eye. Alternatively, however, color layer 30 may be fabricated as a separate planar member which is secured to rear surface 15 using conventional adhesive attachment or the like. The important aspect of the color layer 30 is to provide a plurality of color areas positioned upon rear surface 15 of eye body 10 (seen in FIG. 2). In the embodiment of the present invention shown in FIG. 3, color layer 30 defines a small circular highlight area 33 preferably formed of a white pigmented material surrounded by a darker color area 34 preferably pigmented in a black or extremely dark color. A medium tone color area 35 preferably pigmented of a blue color partially surrounds color area 34. Finally, a color area 36 preferably pigmented of a light color such as white partially encircles color area 35. The combined color areas forming color layer 30 define an outer edge 31 which is coincident with outer edge 13 of eye body 10 (seen in FIG. 1).

In the event color layer 30 is formed of a separate planar element, an aperture 32 is formed therein to receive attachment post 12 as color layer 30 is secured to rear surface 15. Alternatively, in the event color layer 30 is formed directly upon rear surface 15 by successive applications of color pigmented materials forming highlight 33 and color areas 34 through 36, aperture 32 in color area 30 is in effect formed during the color pigment application. Where direct color pigment application is utilized, it may be preferable to apply a color pigmented material corresponding to the pigmented material used for color area 34 directly to attachment post 12 (seen in FIG. 4) to render attachment post 12 virtually invisible when the completed eye structure is viewed from the front direction.

Thus, in the preferred fabrication of the present invention, eye body 10 (seen in FIG. 2) is provided with color layer 30 by direct application to rear surface 15 using a conventional color printing technique such as tampo printing or its equivalent to form color areas 34 through 36 together with highlight 33 directly upon rear surface 15. In addition, post 12 is preferably covered with a dark or black pigmented color material.

FIG. 4 sets forth a side view of the completed structure of the present invention simulated eye generally referenced by numeral 40. Simulated eye 40 is fabricated by the above-described combination of eye body 10 and color layer 30. Thus, simulated eye 40 includes eye body 10 having lens 11 and attachment post 12 preferably formed of an integral molded member. Lens 11 defines a planar rear surface 15, an outer edge 13 and a front surface 14. Eye 40 further includes multiply colored color layer 30 upon rear surface 15 and having an outer edge 31 coincident with outer edge 13 of lens 11. Attachment post 12 includes a dome-shaped end 20 and a plurality of ribs 21. Attachment post 12 is shown covered with a dark preferably black pigmented material which in its preferred form matches color area 34 (seen in FIG. 3).

In accordance with an important aspect of the present invention, FIG. 4 shows a plurality of color area appearance portions 44, 45 and 46 together with highlight appearance portion 43 which due to the optical characteristics of convex lens 11 appear to fill lens 11 of eye body 10. Thus, highlight appearance portions 43 appears placed upwardly within lens 11 and is formed by the effect of lens 11 upon highlight 33 of color layer 30. Similarly, color area appearance portion 44 appears to fill a portion of lens 11 and results from the effect of lens 11 upon color area 34 of color layer 30. Similarly, color appearance area portions 45 and 46 appear to fill portions of lens 11 and result from the effect of lens 11 upon color areas 35 and 36. The application of pigment material to post 12 which matches color area 34 of color layer 30 substantially masks attachment post 12 rendering it virtually invisible when simulated eye 40 is secured within a host doll or plush toy and viewed from a frontal relationship through outer surface 14 of lens 11. In its preferred form, attachment post 12 is inserted into a host receptacle (not shown) formed within a doll or plush toy in accordance with conventional fabrication techniques to secure simulated eye 40 to a host doll or plush toy. It will be apparent to those skilled in the art, however, that other attachment apparatus may be utilized in securing attachment post 12 within a doll or plush toy figure without departing from the spirit and scope of the present invention. In accordance with an important aspect of the present invention, the curvature of outer surface 14 of lens 11 provides different refractive effects upon the appearance of highlight 33 and color areas 34 through 36 of simulated eye 40 as the viewer changes orientation with respect to the simulated eye. This provides a substantial improvement in the appearance of the present invention simulated eye and its interest and amusement value.

It will be apparent to those skilled in the art that while the present invention simulated eye is shown having a single highlight and three color areas, other combinations of highlight and color areas may be utilized in the present invention combination without departing from the spirit and scope of the present invention. One modification of the present invention which is believed to provide substantial appearance improvement is to apply color layer 30 in a manner which provides a blended or transitional portion between each of colors areas 34 through 36. Thus, while distinct color areas are shown in color layer 30 in FIG. 3, it will be apparent to those skilled in the art that gradual transition portions between each color area are well within the spirit and scope of the present invention.

What has been shown is a novel simulated eye for toys having a convex lens body which utilizes a plurality of color areas formed on the rear surface of the lens to provide a novel appearance effect. The eye body is preferably formed of a molded plastic integral member having an attachment post extending therefrom for easy attachment to a host doll or plush toy figure. The simulated eye may be fabricated in different shapes such as round or elliptical and may utilize a variety of color area patterns in accordance with the user's design preferences.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A simulated eye for use in combination with a toy, said simulated eye comprising:

a convex lens having a lens body defining a convexly curved generally tear-drop shaped front surface and a generally planar rear surface and a generally tear-drop shaped outer edge;

means for attaching said convex lens to a toy including an attachment post extending from said rear surface; and a color layer having a plurality of differently colored color areas formed upon said rear surface including a generally circular highlight area, said convex lens and said color areas cooperating to cause said color areas to appear to fill said lens body when said simulated eye is viewed from a frontal position, wherein said tear-drop shape defines a generally circular end and a generally pointed end and wherein said color areas include a darkest pigment area extending from said generally pointed end, a lightest pigment area extending from said generally circular end and an intermediate pigment area therebetween.

2. A simulated eye as set forth in claim 1 wherein said generally circular highlight area is formed within said darkest pigment area.

3. A simulated eye as set forth in claim 2 wherein said darkest pigment area covers the portion of said rear surface from which said post extends and wherein said post is covered in a color material having said darkest pigment.

4. A simulated eye comprising:

a lens having a lens body, said lens body defining a general tear-drop shape formed of a generally circular end and a generally pointed end, said lens body further defining a convex front surface and a generally planar rear surface;

a darkest pigment color area formed on said rear surface and extending from said generally pointed end;

a lightest pigment color area formed on said rear surface and extending from said generally circular end; and an intermediate pigment color area formed on said rear surface between said darkest and lightest pigment color areas, said lens body and said color areas on said rear surface cooperating to cause said color areas to appear to fill said lens body.

5. A simulated eye as set forth in claim 4 wherein said darkest pigment color area further defines a small generally circular highlight area having a pigment substantially lighter than said darkest pigment.

* * * * *